US009121225B2

(12) United States Patent
Gregory

(10) Patent No.: US 9,121,225 B2
(45) **Date of Patent: *Sep. 1, 2015**

(54) DRILL BIT HOUSING VIBRATOR AND METHOD

(71) Applicant: CNPC USA CORPORATION, Houston, TX (US)

(72) Inventor: Marvin A Gregory, Spring, TX (US)

(73) Assignee: CNPC USA Corp., Houston, TX (US)

( * ) Notice: Subject to any disclaimer, the term of this patent is extended or adjusted under 35 U.S.C. 154(b) by 416 days.

This patent is subject to a terminal disclaimer.

(21) Appl. No.: 13/692,592

(22) Filed: Dec. 3, 2012

(65) Prior Publication Data

US 2014/0151125 A1 Jun. 5, 2014

(51) Int. Cl.
*E21B 7/24* (2006.01)
*E21B 28/00* (2006.01)

(52) U.S. Cl.
CPC .. *E21B 7/24* (2013.01); *E21B 28/00* (2013.01)

(58) Field of Classification Search
CPC ..... E21B 7/24; E21B 7/20; E21B 7/068; E21B 4/02; E21B 17/20; E21B 43/003; E21B 28/00; E21B 31/005
USPC ..... 166/177.6
See application file for complete search history.

(56) References Cited

U.S. PATENT DOCUMENTS 2,970,660 A 7/1954 Bodine
2,742,265 A * 4/1956 Snyder ..... 175/56
2,743,083 A 4/1956 Zublin
2,746,721 A 5/1956 Moore
2,780,438 A 2/1957 Bielstein
2,925,252 A 2/1960 Minor
3,152,642 A 10/1964 Bodine
3,155,163 A 11/1964 Bodine
3,168,140 A 2/1965 Bodine
3,500,908 A 3/1970 Barker
3,640,351 A 2/1972 Coyne et al.
3,894,818 A 7/1975 Tschirky
3,899,033 A 8/1975 Van Huisen
3,933,209 A 1/1976 Sweeney
3,941,196 A 3/1976 Currington et al.
4,429,743 A 2/1984 Bodine
4,667,742 A 5/1987 Bodine (Continued)

FOREIGN PATENT DOCUMENTS

WO PCT/GB2007/002553 1/2008

OTHER PUBLICATIONS

Wikipedia Article "Vibrating structure gyroscope"—screen shot from Nov. 27, 2007.*

(Continued)

*Primary Examiner* — Nicole Coy
*Assistant Examiner* — Tara Schimpf
(74) *Attorney, Agent, or Firm* — Andrew W. Chu; Craft Chu PLLC

(57) ABSTRACT

A vibration system for drill bit housing and method is disclosed, which may be utilized to assist in lowering a drill string into a wellbore through which drilling fluid is pumped. In one embodiment, a drill bit housing contains a symmetrical rotatable member positioned to rotate in response to drilling fluid pumped through the housing, whereby a mechanical interconnection connected to the rotatable member produces vibrations within the drill bit housing for advancing bottom hole assemblies.

7 Claims, 6 Drawing Sheets

(56) References Cited

U.S. PATENT DOCUMENTS

| | | | | |
|---|---|---|---|---|
| 4,817,739 | A | 4/1989 | Jeter | |
| 4,819,745 | A | 4/1989 | Walter | |
| 4,830,122 | A | 5/1989 | Walter | |
| 4,979,577 | A | 12/1990 | Walter | |
| 5,009,272 | A | 4/1991 | Walter | |
| 5,190,114 | A | 3/1993 | Walter | |
| 5,662,180 | A | 9/1997 | Coffman et al. | |
| 6,279,670 | B1 | 8/2001 | Eddison et al. | |
| 6,439,318 | B1 | 8/2002 | Eddison et al. | |
| 6,508,317 | B2 | 1/2003 | Eddison et al. | |
| 2008/0099245 | A1 * | 5/2008 | Hall et al. | 175/57 |
| 2009/0072061 | A1 | 3/2009 | Yao | |
| 2009/0173542 | A1 | 7/2009 | Ibrahim | |
| 2012/0048621 | A1 * | 3/2012 | Stewart et al. | 175/56 |

OTHER PUBLICATIONS

Swanson et al., A Practical Review of Rotating Machinery Critical Speeds and Modes, Sound and Vibration Magazine, May 2005.

* cited by examiner

DRILL BIT HOUSING VIBRATOR AND METHOD

BACKGROUND OF THE INVENTION

1. Field of the Invention

The present invention relates generally to vibrator tool assemblies and, in one possible particular embodiment, to a vibration system for drill bit housing to produce vibrations for advancing bottom hole assemblies in oil and gas operations.

2. Description of the Prior Related Art

Oil and gas operators have continually found new methods of incorporating coiled tubing into various rig applications. Coiled tubing often has advantages over a conventional rig and drillstring, in that coiled tubing units can be less expensive and quicker to set up than conventional drilling rigs.

One major problem to both conventional and coiled tubing rigs is the ability to push tubing further into a wellbore under certain drilling conditions. Generally, drillers rely on the weight of the drillstring to counteract the frictional forces generated between the wellbore and drillstring. Once a certain depth is reached, or certain formations are drilled into, or at certain angles of the wellbore, the weight of the drill string is not sufficient to overcome the friction of the drill string to move the drill string downwardly as drilling continues. This tends to be especially true in coiled tubing operations, because coiled tubing cannot be rotated at the surface to overcome or reduce the friction the drill string with respect to the wellbore. Another significant factor is that coiled tubing tends to be more flexible and lighter compared to traditional drill pipe. As a result, coiled tubing may experience increased drag problems in the wellbore as compared with traditional drill pipe and is more prone to become lodged in the wellbore. This effect can become exacerbated in deviated wells and those with horizontal sections, where movement of pipe by the injector rig at the surface does not result in additional movement of the coiled tubing string into the wellbore. Furthermore, coiled tubing is more likely to stick in the wellbore based on the coiled design and spooled storage, which can create a spiral effect that may increase the number of sticking points inside the wellbore.

Various tools and methods have been utilized to deal with this problem, including vibrating tools, jars, tractors, centralizers, and pulsators. Thus, many designs have been utilized. While such tools have been utilized successfully, the forces created thereby are not necessarily efficient in utilizing the energy created thereby. Accordingly, the present invention will be appreciated by those of skill in the art.

SUMMARY OF THE INVENTION

One possible object of the present invention is to provide an improved vibrational tool for use in a bottom hole assembly.

Another possible object of the present invention is to provide a tool to overcome drag between coiled tubing and the inside of a wellbore.

Another possible object of the present invention is to provide a vibrational tool within a bit housing.

Another possible object of the present invention is to provide a tool that produces vibrations that are directed substantially in line downwardly and/or upwardly axially in line with the drilling string Another possible object of the present invention is provide a stabilizing gyroscopic effect due to rotation of a symmetrical mass around the axis of the tool.

These objects, as well as other objects, advantages, and features of the present invention will become clear from the description and figures to be discussed hereinafter. It is understood that the objects listed above are not all inclusive and are intended to aid in understanding the present invention, not to limit the scope of the present invention.

Accordingly, the present invention may comprise a vibration system for use with a drill bit attached to tubular string in a well bore through which drilling fluid is pumped, comprising a drill bit housing, drill bit cutters secured to said drill bit housing, a symmetrical rotatable member positioned within said drill bit housing to rotate in response to drilling fluid flow through said drill bit housing, and a mechanical interconnection to said rotatable member whereby said rotatable member and said mechanical interconnection operate to produce vibrations within said drill bit housing.

In one embodiment, the mechanical interconnection may further comprise a pair of engagement surfaces which rotate with respect to each other.

The present invention may further comprise a spring assembly to keep the pair of engagement surfaces together and a reciprocating member.

In another embodiment, a first of the pair of engagement surfaces may be mounted to the rotatable member and a second of the pair of engagement surfaces may be mounted to the reciprocating member. The reciprocating member may comprise one or more recesses and protrusions.

In another embodiment, the present invention may comprise a vibration system for use with a drill bit attached to tubular string in a well bore through which drilling fluid is pumped, comprising a drill bit housing, drill bit cutters secured to said drill bit housing, a reciprocating member mounted in the drill bit housing operable for reciprocating in response to fluid flow through the drill bit housing for producing vibrations.

In another embodiment, a rotating member may be mechanically interconnected to the reciprocating member. A spring assembly may urge the reciprocating member towards the rotating member.

In one embodiment, the rotating member may comprise a plurality of grooves through which it receives the fluid flow for producing forces that rotate the rotating member. The grooves may comprise a plurality of branches.

In one embodiment, the rotating member is mounted to rotate around an axis which is aligned to the tubular string to which the drill bit is attached.

In another embodiment, a method for a drill bit attached to tubular string in a well bore through which drilling fluid is pumped may comprise steps such as providing a drill bit housing, providing that drill bit cutters are secured to the drill bit housing, and mounting a rotatable member within the drill bit housing to rotate generally or approximately around an axis in line with the tubular string to which the drill bit is attached in response to drilling fluid flow through the drill bit housing for producing a gyroscopic effect in the drill bit housing. In one embodiment, vibrations may or may not be produced. In one embodiment, the gyroscopic effect may be used by itself for smoother drilling. A flexible sub may be utilized to interact with the gyroscopic effect to direct the drill bit for directional drilling.

In another embodiment, the method may comprise providing a mechanical interconnection to the rotatable member whereby the rotatable member and the mechanical interconnection operate together to produce vibrations within the drill bit housing.

The method may further comprise providing the mechanical interconnection comprises a pair of engagement surfaces which rotate with respect to each other.

Other steps may include providing a spring assembly to urge the pair of engagement surfaces together, interconnecting a reciprocating member to the rotatable member, and providing that the reciprocating member reciprocates in alignment with the axis.

BRIEF DESCRIPTION OF THE DRAWINGS

A more complete understanding of the invention and many of the advantages thereto will be readily appreciated as the same becomes better understood by reference to the following detailed description when considered in conjunction with the accompanying drawings, wherein.

DETAILED DESCRIPTION OF THE INVENTION

Figure 1:
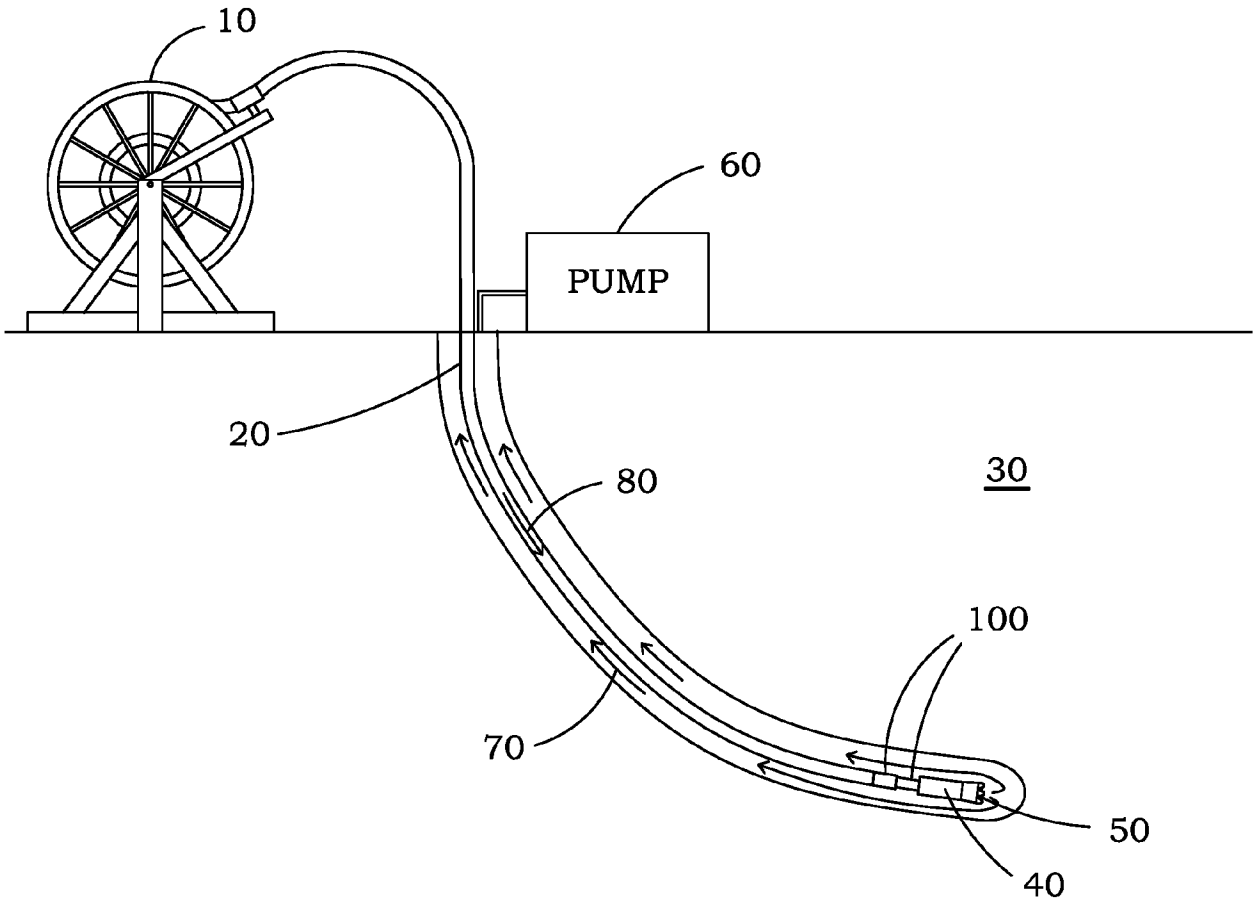
FIG. 1 is a side elevational schematic view, partially in section, which discloses the use of the invention in the wellbore accord with one possible embodiment of the invention.

Referring now to the drawings, and more particularly to FIG. 1, there is shown coiled tubing unit 10 with coiled tubing 20 extending into earth 30. In this example, turbine 40 is rotating bit 50. Turbine 40 spins in response to drilling fluid pumped by pump 60 which pumps drilling fluid 80 down the tubing and drilling fluid 70 outside the tubing through the annulus back to pump 60.

It will be noted that the drawings are intended to be conceptual embodiments of the invention, which may be shown greatly simplified or exaggerated to emphasize the various concepts of the invention. The drawings are not intended to be manufacturing level drawings. Moreover, to the extent terms such as "upper," "lower," "top," "bottom," and the like are utilized herein they refer to the drawings. The tool 100 may be oriented differently during operation or transport than shown.

One or more vibrator sections 100 in accord with the present invention may be utilized to assist downward movement of the coiled tubing 20 or other tubular strings. Vibrators 100 may be positioned above or below turbine 40 and, if desired, can be rotated with bit 50. In one embodiment shown in FIG. 4 and discussed hereinafter, one or more vibrator sections may be built into the bit housing 50 itself, if desired, and used either with or without other vibrator sections.

Vibrators 100 can be especially desirable in high angle or horizontal wells where the weight of the string may not be adequate in itself or not at all to cause the tubing to move downwardly for drilling. Vibrator sections 100 utilize drilling fluid flow 80 to vibrate, activate, move, oscillate, or otherwise work the string in order to move the drill string further down the hole to, for example, drill deeper. In one possible embodiment of the present invention, pulsating resistance to drilling fluid flow creates vibrations that tend to push the string into the wellbore.

Figure 2A:
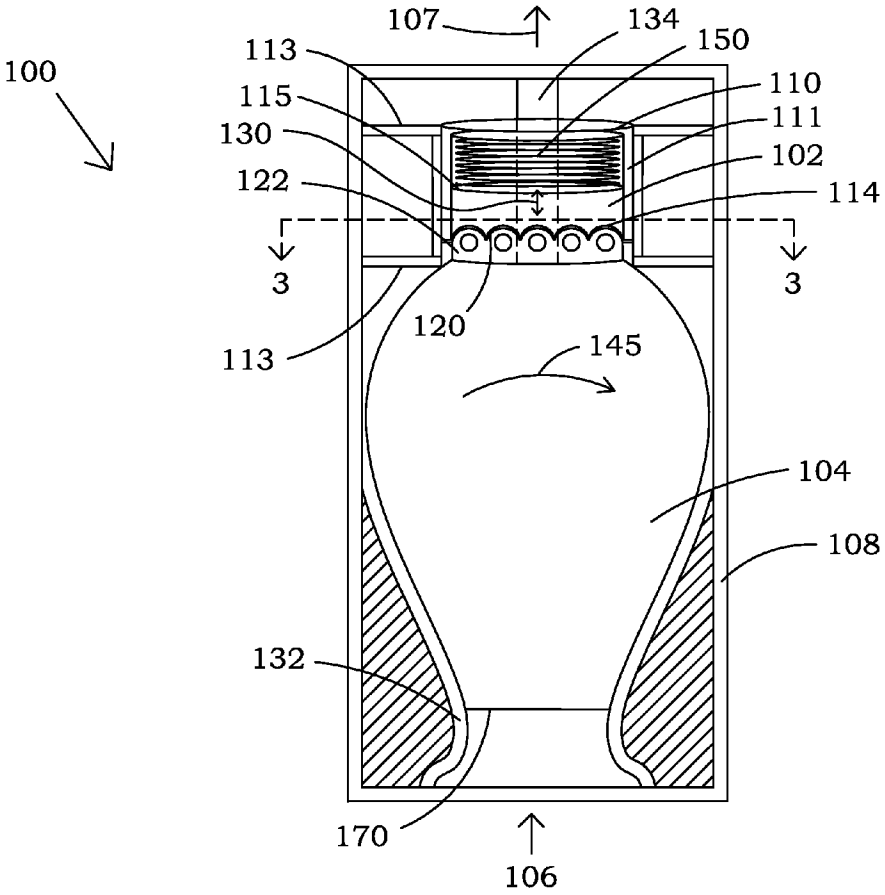
FIG. 2A is an elevational view, partially in section, showing spring loaded cam members mounted between a symmetrically rotating mass and a reciprocating member, with the camming surfaces in a first position in accord with one possible embodiment of the invention.
Figure 2B:
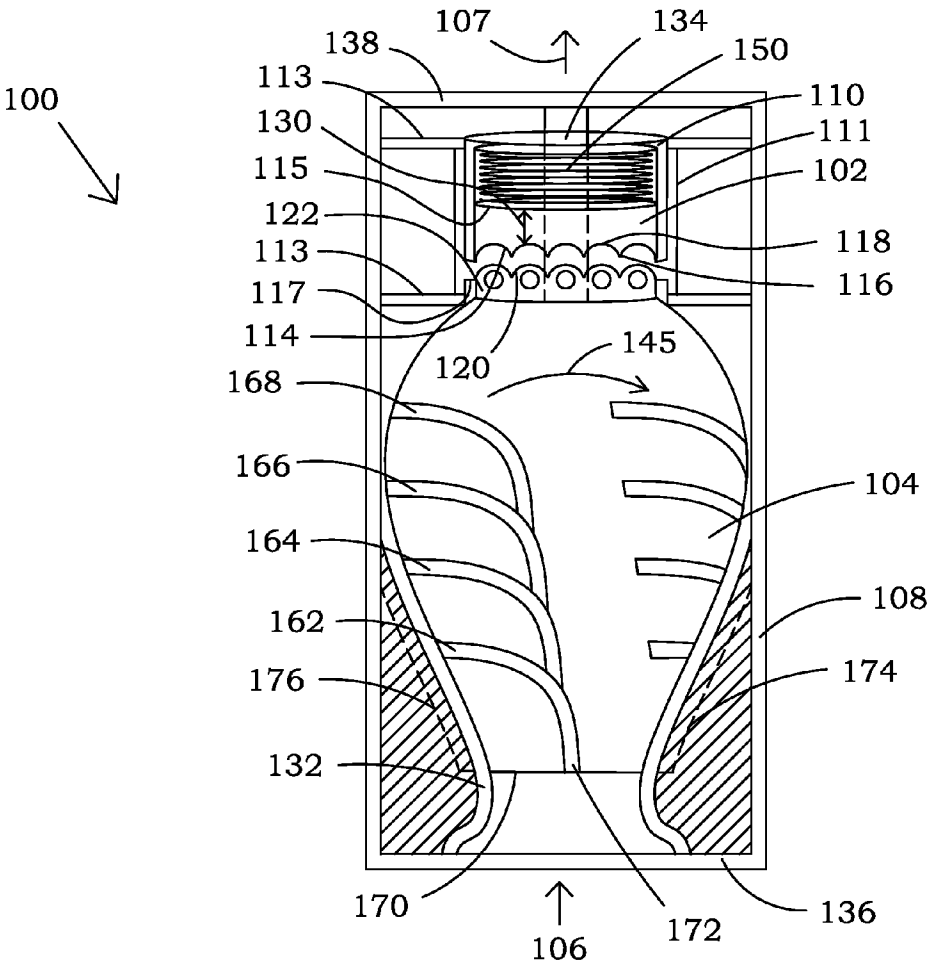
FIG. 2B is an elevational view, partially in section, showing the cam members, which comprise protrusions and recessions of various types in a more separated position, in accord with one possible embodiment of the invention.

FIGS. 2A and 2B show one possible embodiment of internal components of vibrator 100. Vibrator 100 may comprise sliding member 102, sometimes referred to herein as reciprocating member 102, which reciprocates upwardly and downwardly (as per drawing orientation) as indicated by arrow 130. Reciprocating member 102 may be cylindrical but other shapes, e.g., triangular, square, hexagonal, and other shapes, could also be possible at least for portions of reciprocating member 102.

In this embodiment, reciprocating member reciprocates in response to camming action, discussed hereinafter, and rotation of mass 104, which rotates in response to flow of entering drilling fluid as indicated by flow arrow 106 into tubular vibrator housing 108 and exiting as indicated by flow arrow 107.

It will be understood that the drawings are intended to show concepts and that many variations are possible, only some of which are discussed hereinafter. For example, in one possible embodiment, reciprocating member may not be utilized and/or may be oriented differently with respect to mass 104. The camming action could move other components and might be utilized to cause reciprocation of rotating mass 104, which could be spring loaded in some way.

In FIG. 2A, engagement surface 120 on upper portion 122 of rotating mass 104 meshes or cams or follows with engagement surface 114 of reciprocating member 102. In FIG. 2A reciprocating member 102 is spring loaded and reciprocates with respect to rotating mass 104 due to camming or following action as mass 104 rotates while reciprocating member 102 is prevented from rotation. In other words, as the protrusions and recessions, or camming surfaces of surface 120 and 114, rotate with respect to each other, reciprocating member 102 is pushed away from and then urged back towards mass 104 by spring 150. However, as noted above, the present invention is not limited to this embodiment.

Accordingly, in one embodiment of vibrator 100, a mechanical connection connects rotation of mass 104 and changes the rotating motion of rotating mass 104 to reciprocating motion of reciprocating member 102. Many different types of mechanical connections could be utilized to interconnect rotating mass 104 to reciprocating member 102 including geared connections, fluid connections, insertions, strap or chain connections, hydraulic connections, and the like. Mechanical connections of various types could be utilized between rotating mass 104 and reciprocating member 102 to create vibrations, different types of jarring effects, and the like. However, in the embodiment of FIG. 2A, FIGS. 2B, and 3, vibrator 100 utilizes sturdy camming, or following action and drilling fluid flow to create the vibrations thereof.

In this embodiment, frame 110 supports reciprocating member 102 therein for sliding or reciprocating motion of reciprocating member 102. Frame 110 may be secured to vibrator housing 108 by various means such as but not limited to mounts 113. As shown in FIG. 2A, guide members 111, slots, or the like in the sides of frame 110 may be utilized to allow sliding axially directed motion of reciprocating member 102 but prevent rotation of reciprocating member 102. Because in this embodiment reciprocating member 102 cannot rotate, reciprocating member is constrained to reciprocate in response to rotation of mass 104. Reciprocating member 102 may comprise various shapes. In one embodiment, reciprocating member 102 comprises a tubular sliding section upward section, which reciprocates generally along the axis of tubular vibrator housing 108. Reciprocating member 102 and/or frame 110 may also have a middle portion, upper portion or other portions one or more of which can be circular, elliptical, triangular, square, rectangular, star shaped or the like. If desired, reciprocating member 102 or portions thereof may be solid and weighted or may be of relatively light weight. In any case, reciprocating member 102 and frame 110 are sufficiently sturdy to undergo significant vibration over long periods of time. If desired, weights may be added or removed from reciprocating member 102.

In one embodiment, reciprocating member or mass 102 may also engage stops, anvils, or the like 117, which may be utilized on either or both ends of the sliding travel during each stroke, which may repeatedly make contact in jarring fashion if desired. Reciprocating member 102 could be designed to engage upper surfaces or lower surfaces or both in frame 110 with a jarring action as described in one embodiment here.

Figure 3:
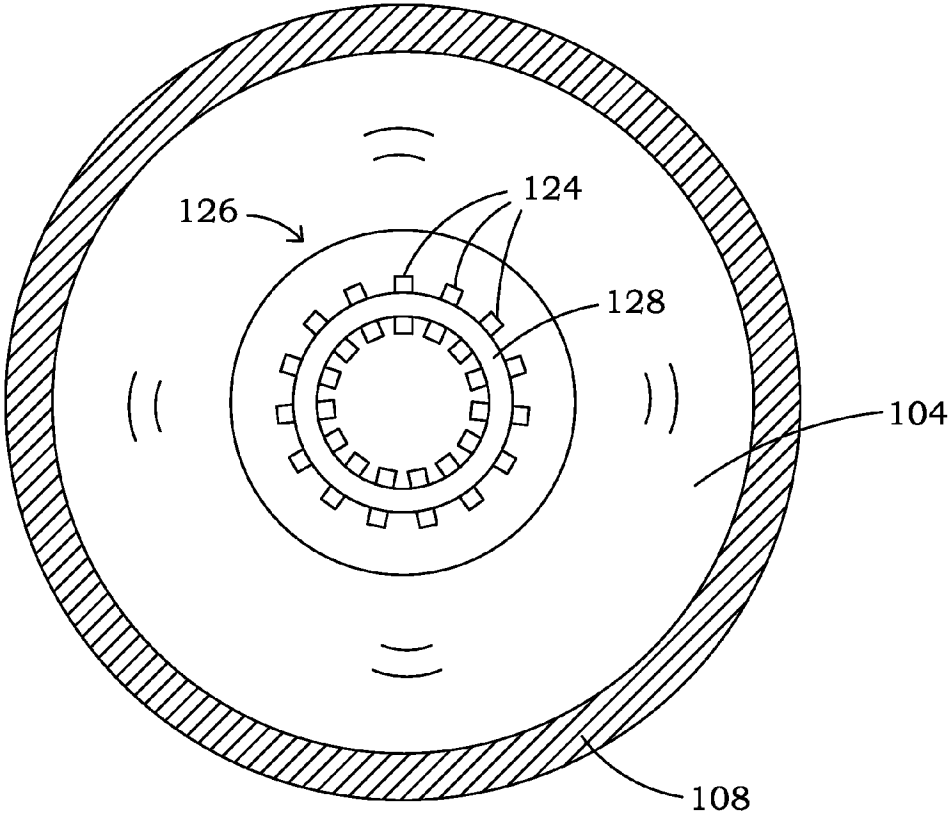
FIG. 3 is a top view, taken along lines 3-3 of FIG. 2A, showing roller bearings that can be utilized as cam members accord with one possible embodiment of the present invention.

Accordingly, in one embodiment shown in FIG. 2A, FIG. 2B, and FIG. 3, camming engagement surfaces 114 and 120 are utilized to provide reciprocating motion of member 102. Reciprocating member 102 may be of different sizes and lengths as desired. The stroke of reciprocating member 102 is determined by the length of the protrusions and recessions of engagement surfaces, such as recessions 118 and protrusions 116, which may vary in one embodiment, but are not limited to, between one-quarter inch and one inch.

While spring 150 is shown on the top side of reciprocating member 102 in the orientation of FIG. 2, the spring could be on the bottom side to create a jarring against the upper surface of frame 110 whereby reciprocating member 102 could be, for example only, tightened, spring-loaded, and released for acceleration again a jarring surface such as the top of frame 110 by an engagement mechanism with rotating mass 104. Thus, the embodiment shown in the figures with spring 150 above reciprocating member 102 is only one possible embodiment of construction and operation. In another embodiment, spring 150 could be utilized to spring load rotating mass 104 to provide axially directed vibrational forces produced by mass 104 instead of reciprocating member 102, which may also include jarring action at one end or the other of travel.

Accordingly, in one possible non-limiting example, reciprocating member 102 has an engagement end or surface 114 at a bottom end, which may be more clearly shown in FIG. 2B. Engagement end or surface 114 may operate as a type of cam. At the opposite end of reciprocating member 102, reciprocating member 102 may comprise spring loaded end 115. Spring-loaded end 115 may be energized with spring 150, which urges engagement surface 114 of reciprocating member 102 against engagement surface 120 on mass 104. The engagement surfaces 114 and 120 on each end, when rotated with respect to each other, cause a cam following motion, which in this embodiment, constrains spring-loaded reciprocating member 102 to reciprocate because reciprocating member 102 does not rotate and rotating mass 104 is axially fixed in position and does not reciprocate.

Spring 150 may comprise a spring assembly, which may be of many constructions. Spring 150 may comprise a spring or spring assembly which is intended to refer any type of mechanism to urge the engagement surfaces together including coiled resilient metal springs, compressed gas, multiple coiled springs, leaf springs, compression springs, extension springs, torsion springs, tapered springs, multi-spring combinations, magazine springs, elastomeric members, foam springs, combinations thereof, or any desired types of springs and is intended generally to cover resilient members that are operative as described in this embodiment. Conceivably the flow of drilling fluid might be utilized as an urging mechanism if the components are reconfigured. If the system were reversed in position with respect to fluid flow, then fluid flow could be directed to provide the spring or urging mechanism that urges the camming surfaces together.

In this embodiment, the tension required to compress spring 150 and the mass of reciprocating member 102 relates to the intensity of vibrations produced during operation. However, various factors such as spring tension, mass of reciprocating member 102, mass of rotating mass 104, stops or anvils 117 at the end of the stroke of reciprocating member 102, the length of the protrusions/recessions of the engagement surfaces, different types of turbine or rotor fins, blades, grooves or the like will affect the vibration frequency and intensity and pattern of the vibrations produced by vibration tool 110.

In the embodiment of FIG. 2A and FIG. 2B, engagement surface 114 has variations such as protrusions 116 and/or recessions 118. In one embodiment, the surfaces such as protrusions 116 may be much smoother than shown, and in one embodiment the engagement surfaces may preferably be smooth or undulating, and spaced at any desired intervals, of any desired number, as is related to frequency characteristics and motions of vibrations produced thereby.

Accordingly, in one embodiment, engagement ends or surfaces 114 and 120 may comprise camming surfaces whereby the protrusions 116 and/or recessions 118 may preferably be smooth and quite rounded to produce a cam following type of action. However, if desired, the protrusions may slope upwardly and come to a distinct sharp edge whereby only one or two significant vibrations or jars occur per rotation of mass 104. Thus, the engagement surfaces may not be completely smooth.

A relatively larger number of protrusions may be utilized to produce higher frequency vibrations. Irregular vibrations may be produced by spacing the cams at irregular or non-symmetrical spacing. Accordingly, the arrangement of protrusions and recessions may allow the vibrations to occur at a continuous frequency or at irregular frequencies, e.g., several quick beats and/or pauses and one beat, or the like, depending on the spacing of the cams. For example, with only one camming element, then only one beat might be produced per revolution of mass 104. In another example, multiple and/or irregular beats may be produced per revolution of mass 104. Accordingly, the number of protrusions/recessions and the spacing therebetween may be selected to create a desired frequency of vibration and motion. In one embodiment, the camming surfaces, such as protrusions 116 and/or recessions 118 and/or camming surfaces 120 may be interchangeable to change the vibration frequencies.

In one embodiment, corresponding camming surfaces 120 are provided on engagement end 122 of mass 104, which is the upper end as shown in FIG. 2. Camming engagement surfaces 120 may be of various types, shapes, and the like.

In one embodiment, roller bearings may be, but are not required to be utilized as camming surfaces 120. FIG. 3, which is cross-section 3-3 of FIG. 2A, looks down on roller bearing assembly 126, which may comprise roller bearings 124, as part of bearing race 128, which is fastened with respect to mass 104, and is fixed in position. Roller bearings 124 may be free to rotate individually but the roller bearing assembly 126 is fixed in position with respect to mass 104, so as to rotate with mass 104.

The camming surfaces may be reversed in position. In other words, the roller bearings could be affixed to reciprocating member 102 and/or roller bearings or other bearings could be used on both reciprocating member 102 and rotating mass 104. Other types of frictionless bearings such as roller bearings, cylindrical bearings, ball bearings, thrust bearings, tapered bearings, combinations of the above, and the like may be utilized. Due to the opening and closing action, the camming surfaces are highly lubricated with each vibration, oscillation, or the like. Lubrication fluid may comprise the drilling fluid directed onto the camming surfaces and/or the camming surfaces may be mounted within a lubrication chamber.

Accordingly, in this embodiment, in response to rotation of mass 104, member 102 reciprocates as indicated at arrow 130. In this embodiment, spring 150 is positioned at a top end (as shown in the orientation of FIGS. 2A and 2B) of reciprocating member 102 to urge engagement of engagement surface 114 against engagement surface 120 of mass 104.

In one possible embodiment, mass 104 may rotate at least substantially symmetrically around the axis of vibrator housing 108. Mass 104 arrow 145 indicates rotation of mass 104 but is not intended to necessarily show the direction of rotation, which may be in either direction, depending on the rotary drive features such as blades, grooves, or the like in rotating mass 104. Mass 104 may be mounted by various mounting such as rotary mountings 132 and shaft 134 on opposite axial ends of rotating mass 104. Rotary mountings 132 and 134 may in one embodiment be secured to housing 108 by support members 136 and 138 (shown at top and bottom of FIG. 2B). In one non-limiting embodiment, rotary mountings 132 and 134 are designed to prevent axial movement. Rotary mountings 132 and 134, and/or different types or numbers of mountings, may be utilized. Accordingly, in one possible preferred embodiment rotating mass 104 rotates in the axis of housing 108 but does not move axially. However, in another embodiment, rotating mass 104 may move axially for jarring action. Camming surfaces could be provided along the sides of rotating mass 104 and/or ends thereof to facilitate axial and rotational movement of a spring-loaded mass. In yet another embodiment, the drilling fluid may act as the spring force because the drilling fluid acts to urge a member in the direction of fluid flow.

Rotating mass 104 may comprise various shapes and can be generally rounded with a relatively flattened top, as shown in FIG. 2A and FIG. 2B. However, rotating mass 104 could be conical and have a triangular cross-section with relatively straight or slightly curving sides. In one embodiment, rotating mass 104 increases in diameter in the direction of fluid flow or the top (as shown in FIG. 2A or 2B) in order to more fully and efficiently pull power out of the drilling fluid flow. In this embodiment, mass 104 increases in diameter in the direction of drilling fluid flow until reaching the top or another position at which time the drilling fluid is directed as desired, such as into the camming surfaces for lubrication purposes. Thus, in one presently preferred embodiment, from end 170 where fluid enters to drive rotating mass 104, at least a portion of rotating mass 104 increases in diameter.

In one embodiment, rotating mass 104, which rotates around an axis of housing 104, which is also in line with the axis of the tubing connected thereto, may be utilized to produce a gyroscopic effect to stabilize the position of the tubing within the wellbore. Mass 104 may comprise a diameter in the range of but not limited to from 60 to 90 percent of the diameter of the tubing or housing 108, and a length in the range of but not limited to from 40 to 80 percent of the length of housing 108. Accordingly, the size of rotating mass 104 can be significant with respect to vibration tool 100. If mass 104 is substantially solid metal, and depending of the rotational speed of mass 104, the gyroscopic lateral stabilizing effect produced around the axis of housing 108 can be significant.

Mass 104 may be built in longitudinal sections so as to be more easily constructed. The grooves or fins of mass 104 utilized to rotate mass 104 in response to fluid flow may then be more easily formed, machined, cast or the like. Fasteners can then be used to put the sections of mass 104 back symmetrically with the mass of mass 104 being symmetric about the axis of vibrator housing 108.

In one embodiment, the amount of mass of mass 104 is much greater, in the range of 50 to 100 times or more than the mass of reciprocating member 102. In this embodiment, mass 104 may be largely solid and may therefore comprise in the range of but not limited to 30 to 80 percent of the total mass of vibrator section 100. In one possible embodiment, reciprocating member 102 may comprise less than 10 percent of the total mass of vibrator section 100 and therefore may be considered a relatively lightweight component. In yet another embodiment, reciprocating member 102 may be made much heavier and used for jarring purposes, such as jarring against anvil surfaces 117 in which case reciprocating member 102 may comprise 30 to 80 percent of the total mass of vibrator section 100.

Figure 5:
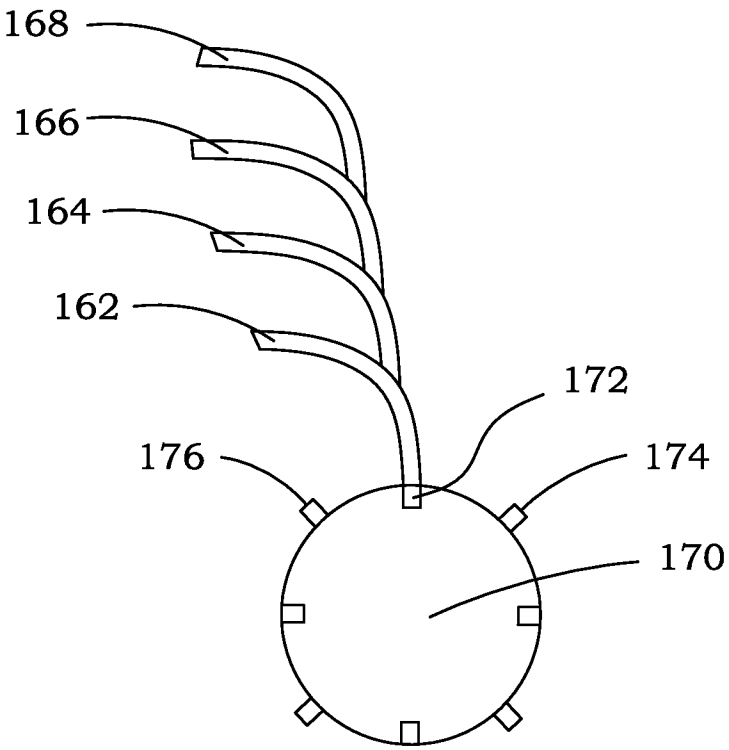
FIG. 5 is a view of a one embodiment of the rotating mass with the grooves, fins, or the like peeled off to show the layout in two dimensions in accord with one possible embodiment of the present invention.

FIG. 2B and FIG. 5 illustrate some non-limiting examples of fluid flow grooves or vanes to provide that mass 104 is effectively a turbine or rotor. One feature of a presently preferred embodiment, where mass 104 is prevented from axial movement, is that the diameter of all flow paths does not change due to paddles or the like that may be inserted in the fluid flow path. In other words, in this embodiment, vibration tool 100 is not driven by paddles or the like that may momentarily block fluid flow when they are engaged by the flow stream. This feature is useful in that a more consistent flow of fluid through vibration tool 100 does not impede operation of the turbine to rotate the drill bit and/or MWD systems that transmit signals to the surface. However, the invention is not limited to this embodiment. For example, if mass 104 were axially moveable and reciprocal, a possibility discussed hereinbefore, then the flow path volume might increase and decrease corresponding to axial movement of mass 104.

FIG. 5 shows a flattened view of conceptual fluid flow lines with bottom 170 of mass 104 shown and the fluid flow lines, grooves, or fins effectively stripped off of mass 104 and flattened to a two dimensional view. FIG. 2B shows one possible view with flow lines on the sides of mass 104. In FIG. 5, fluid flow may enter four openings, grooves, flow lines, fins or the like, such as opening 172. The width and depth of opening 172 may be varied. As well, the flow line, fins, or the like could be formed internally to mass 104 instead of being formed on the external surface as indicated.

Opening 172 then feeds flow lines, grooves, fins, or the like which may split from each other as indicated by 162, 164, 166, and 168 shown conceptually in FIG. 2B and FIG. 5. Thus, in one embodiment, multiple branches are provided.

In one embodiment, in order to keep the fluid pressure in each branch relatively constant so as to maximize the energy derived from the drilling fluid flow, the depths of each subsequent branch may be made shallower so that the total flow pressure through each of the branches until exit of the fluid from each branch is relatively constant. This may be accomplished in different ways. For example, at the split of a branch, e.g., the branch from 162 to 164, the subsequent depth of the groove 162 and initial depth of grove 164 may be halved, with respect to the initial depth of groove 162 as indicated at 172. At the branch from groove 164 to 166, the subsequent depth of groove 164 may be halved and the initial portion of groove 166 may be halved again. The multiple branches and increasing diameter of rotating mass 104 provides that a large amount of the available power in the drilling fluid flow is utilized for rotating mass 104 and producing the pulsating or vibrational power. In another embodiment, additional more elongated fluid flow grooves or fins could be utilized that are longer but do not branch and have a relatively constant depth.

As well fluid flow may also (or may not) be provided through grooves in housing 108 as indicated in dashed lines by grooves 174 and 176 shown in FIG. 2B and FIG. 5. In the embodiment shown in the figures, while rotating mass 104 has at least a portion thereof with an increasing diameter in the direction of fluid flow, housing 108 has a corresponding increasing internal diameter to accommodate rotating mass 104.

Figure 4:
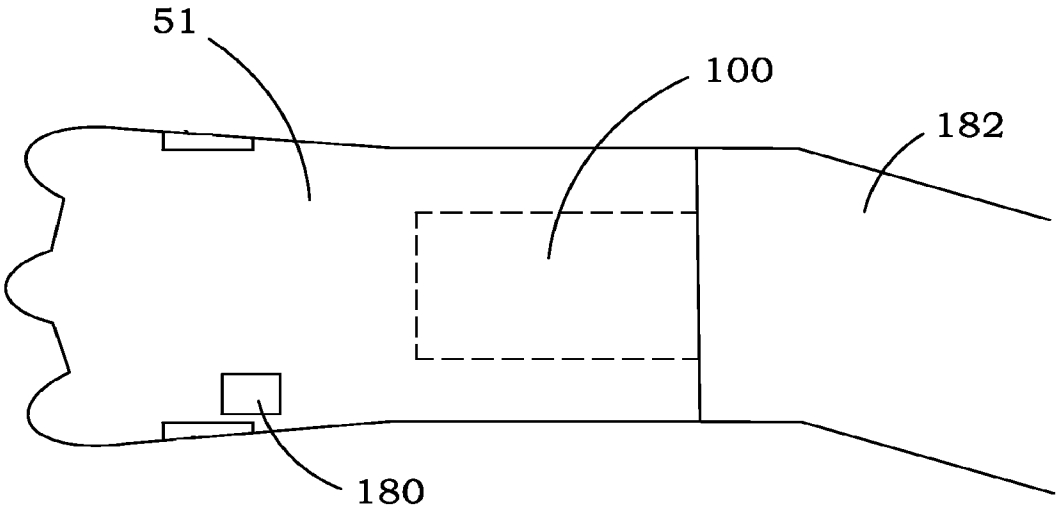
FIG. 4 is an elevational view, partially in hidden lines, showing a vibrator section built into the drill bit housing in accord with one possible embodiment of the present invention.

FIG. 4 shows another embodiment of invention wherein in one embodiment a vibration section 100 is built into housing 51 of the drill bit 50 (shown for example in FIG. 1). Normally, drill bit housing 51 is a very sturdy structure into which bits such as roller cones, PDC cutters, jets, diamond cutters, and the like are built into the housing. Drill bit housings are well known. Vibration section 100 may be as described hereinbefore but could be built using various ways to create vibrations, jarring, or the like. By having the vibration section into drill bit housing 51, the rates of drilling can often be improved significantly. The rotation of mass 104 could be utilized to stabilize the position of the drill bit due to the gyroscopic effect discussed hereinbefore, and prevent or reduce bit whirl should gage inserts try to grab the sides of the wellbore. Moreover, should vibration section 100 cease functioning, as long as the drilling fluid flow continues, then the bit can continue operation so bit reliability is not affected by mounting vibration section 100 therein. Drill bit housing may include sensors 180 built therein as well, which can be sent by systems such as MWD systems or other transmission systems as desired or the data may be stored in a memory for retrieval without the need for a transmission system. Sensors 180 for the bit may comprise vibration sensors to monitor operation of vibration section 100 and/or other sensors such as fluid flow, weight on bit, and the like.

In yet another embodiment, mass 104 may be utilized as a gyro without necessarily utilizing vibrational members. The use of rotating mass 104 as a gyro can be utilized to drill a smoother and/or straighter hole. Moreover, in combination with a flexible housing 182, the gyroscopic effect of mass 104 may be used reactively to aid in steering the drill string. Even a small mass 104 at high speeds can produce large gyroscopic forces, which react strongly to being pushed one way or the other by use of flexible housing 182, which may be of various constructions. Flexible housing 182 may be constructed in different ways to flex in different directions thereby interacting with the gyroscopic effect to enhance and/or control the direction of drilling. Flexible housing 182 may comprise a different sub attached to the bit or may be built into the shank of the drill bit housing itself. The angle shown for flexible sub 182 is exaggerated for effect and will typically comprise much smaller angles as known for directional drilling purposes. Rotating mass 104 can be lengthened and/or used in a different sub for gyroscopic purposes with or without flexible sub 182.

Accordingly, in operation, drilling fluid flow enters vibrator housing 100 as indicated by fluid flow arrow 106 and exits from the opposite end thereof as indicated by flow arrow 107. The drilling fluid flowing through vanes or fins formed on rotating mass 104, which can be of many variations, cause rotation thereof. The rotation of mass 104 causes camming surfaces or engagement surfaces 114 and 120 or other mechanical interconnections to interact and produce reciprocating movement of reciprocating member 102. In this embodiment, spring 150 presses the engagement surfaces together to create varying resistance to rotation of rotating mass 104, which results in vibrations.

However, as discussed in many places above, it will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A vibration system for use with a drill bit attached to tubular string in a well bore through which drilling fluid is pumped, comprising:

a drill bit housing;

drill bit cutters secured to said drill bit housing;

a reciprocating member mounted in said drill bit housing operable for reciprocating in response to fluid flow through said drill bit housing for producing vibrations;

a rotating member mechanically interconnected to said reciprocating member; and a spring assembly that urges said reciprocating member towards said rotating member, wherein said rotating member comprises a plurality of grooves through which receive said fluid flow for producing forces that rotate said rotating member, and wherein said grooves comprise a plurality of branches.

2. The vibration system, according to claim 1, further comprising:

a mechanical interconnection to said rotating member whereby said rotating member and said mechanical interconnection operate to produce vibrations within said drill bit housing.

3. The vibration system of claim 2, wherein said mechanical interconnection comprises a pair of engagement surfaces which rotate with respect to each other.

4. The vibration system of claim 3, a wherein said spring assembly urges said pair of engagement surfaces together.

5. The vibration system of claim 3, wherein a first engagement surface of said pair of engagement surfaces is mounted to said rotating member and a second engagement surface of said pair of engagement surfaces is mounted to said reciprocating member.

6. The vibration system of claim 3, wherein each engagement surface of said pair of engagement surfaces comprises one or more recesses and protrusions.

7. The vibration system of claim 1, wherein said rotating member is mounted to rotate around an axis which is aligned to said tubular string to which said drill bit is attached.

* * * * *